US008372174B2

(12) United States Patent
Schultink et al.

(10) Patent No.: US 8,372,174 B2
(45) **Date of Patent: *Feb. 12, 2013**

(54) VACUUM FILTER CLEANER BAG

(75) Inventors: Jan Schultink, Overpelt (BE); Ralf Sauer, Overpelt (BE)

(73) Assignee: Eurofilters Holding N.V., Overpelt (BE)

( * ) Notice: Subject to any disclaimer, the term of this patent is extended or adjusted under 35 U.S.C. 154(b) by 157 days.

This patent is subject to a terminal disclaimer.

(21) Appl. No.: 12/919,611

(22) PCT Filed: Mar. 3, 2009

(86) PCT No.: PCT/EP2009/001503

§ 371 (c)(1),
(2), (4) Date: Oct. 7, 2010

(87) PCT Pub. No.: WO2009/109361

PCT Pub. Date: Sep. 11, 2009

(65) Prior Publication Data

US 2011/0047945 A1 Mar. 3, 2011

(30) Foreign Application Priority Data

Mar. 7, 2008 (EP) ..... 08004271
Jul. 3, 2008 (EP) ..... 08012059

(51) Int. Cl.
*B01D 46/02* (2006.01)

(52) U.S. Cl. ..... 55/365; 55/368; 55/DIG. 2

(58) Field of Classification Search ..... 55/309, 55/367, 368, 372, 374, 382, 486, DIG. 2, 55/DIG. 5; 96/222, 223, 226, 227; 15/347, 15/352, 353

See application file for complete search history.

(56) References Cited

U.S. PATENT DOCUMENTS

| | | | | |
|---|---|---|---|---|
| 3,370,405 | A | 2/1968 | Fesco | |
| 4,784,676 | A | 11/1988 | Hale | |
| 5,074,997 | A * | 12/1991 | Riley et al. | 96/222 |
| 5,522,908 | A * | 6/1996 | Frey | 55/309 |
| 5,603,741 | A | 2/1997 | Frey | |
| 6,063,171 | A * | 5/2000 | Moyher et al. | 96/226 |

(Continued)

FOREIGN PATENT DOCUMENTS

| | | |
|---|---|---|
| BE | 529 649 | 6/1954 |
| DE | 20 2005 009 452 | 8/2005 |

(Continued)

OTHER PUBLICATIONS

Albrecht et al. "Vliesstoffe", Wiley-VCH, 2000, pp. 186.

*Primary Examiner* — Duane Smith
*Assistant Examiner* — Minh-Chau Pham
(74) *Attorney, Agent, or Firm* — Fay Kaplun & Marcin, LLP

(57) ABSTRACT

A vacuum cleaner filter bag includes (a) a bag wall made of filter material, an inlet opening being provided in the bag wall, (b) a deflecting strip for deflecting an air flow entering through the inlet opening, the deflecting strip being disposed in the interior of the vacuum cleaner filter bag, (c) a material strip which is disposed in the interior of the vacuum cleaner filter bag and connected to the bag wall, at least a part of the edge of the material strip not being connected to the bag wall, and (d) a spacing means which is configured such that the material strip is at a spacing at least partially from the bag wall during operation of the vacuum cleaner filter bag.

16 Claims, 3 Drawing Sheets

U.S. PATENT DOCUMENTS

| | | | | |
|---|---|---|---|---|
| 8,066,803 | B2 * | 11/2011 | Sauer et al. | 96/223 |
| 2008/0314005 | A1 * | 12/2008 | Sauer et al. | 55/368 |
| 2010/0058720 | A1 * | 3/2010 | Sauer | 55/367 |
| 2010/0325833 | A1 * | 12/2010 | Sauer et al. | 15/347 |
| 2012/0131890 | A1 * | 5/2012 | Schultink et al. | 55/368 |

FOREIGN PATENT DOCUMENTS

| | | |
|---|---|---|
| DE | 10 2005 049 118 | 2/2007 |
| DE | 20 2006 019 108 | 2/2007 |
| DE | 10 2005 059 214 | 6/2007 |
| DE | 20 2007 010 692 | 10/2007 |
| EP | 0 960 945 | 12/1999 |
| EP | 1 415 699 | 5/2004 |
| EP | 1 426 090 | 6/2004 |
| EP | 2 011 556 | 1/2009 |
| WO | 2007 / 059939 | 5/2007 |

* cited by examiner

VACUUM FILTER CLEANER BAG

FIELD OF INVENTION

The invention relates to a vacuum cleaner filter bag.

BACKGROUND INFORMATION

An important objective in the development of vacuum cleaner filter bags resides in increasing the serviceable life of the filter bags. The serviceable life over which a vacuum cleaner filter bag can be used until it is filled with dust and/or the pores of the filter material are blocked is intended to be as long as possible, a high suction performance of the vacuum cleaner being sought at the same time over this period of time. Various approaches are known from the state of the art for achieving this objective.

In order to avoid blockage of the filter material forming the bag wall over a longer period of time, EP 0 960 945 discloses a multilayer bag wall construction in which a coarse filter layer is disposed in front of a fine filter layer in the air flow direction.

A vacuum cleaner filter bag is known from WO 2007/059939, which, in its interior, has a deflecting device disposed in the region of the inlet opening for deflecting the air flow entering through the inlet opening. Furthermore, an air-permeable material layer is provided in the interior of the filter bag and is not connected to the filter bag on at least one part of the edge.

SUMMARY OF INVENTION

The present invention relates to a vacuum cleaner filter bag.

It is the object of the present invention to improve the filter bag known from the state of the art further so that a long serviceable life is made possible with a high suction power. This objective is achieved by a vacuum cleaner filter bag according to the claimed invention.

According to the invention, a vacuum cleaner filter bag is provided, comprising a bag wall made of filter material, an inlet opening being provided in the bag wall,

- a deflecting strip for deflecting an air flow entering through the inlet opening, the deflecting strip being disposed in the interior of the vacuum cleaner filter bag,
- a material strip which is disposed in the interior of the vacuum cleaner filter bag and connected to the bag wall, at least a part of the edge of the material strip not being connected to the bag wall, and
- a spacing means which is configured such that the material strip is at a spacing at least partially from the bag wall during operation of the vacuum cleaner filter bag.

Surprisingly, it emerged that such an arrangement of a deflecting strip, a material strip and a spacing means enables a high suction power over a long period of time. It is achieved by the deflecting strip that an incoming air flow does not impinge directly on the material strip. Because of the spacing means, an air flow can flow to the side of the material strip orientated away from the inlet opening. The material strip hence is moved in the air flow, which results in an advantageous distribution of the dust in the bag interior.

The spacing means can be configured in particular such that the material strip, with its side orientated away from the inlet opening, is at a spacing at least partially from the bag wall. Furthermore, the material strip, apart from its connection points to the bag wall, is at a spacing completely from the bag wall.

The spacing means can comprise a piece of material which is provided on the side of the material strip orientated away from the inlet opening. In particular, the spacing means can be configured in the form of the piece of material.

Hence the invention provides a vacuum cleaner filter bag, comprising a bag wall made of filter material, an inlet opening being provided in the bag wall, a deflecting strip for deflecting an air flow entering through the inlet opening, the deflecting strip being disposed in the interior of the vacuum cleaner filter bag, a material strip which is disposed in the interior of the vacuum cleaner filter bag and connected to the bag wall, at least a part of the edge of the material strip not being connected to the bag wall, and a piece of material which is provided on the side of the material strip orientated away from the inlet opening.

The piece of material can be configured in particular such that an air flow is consequently guided on the side of the material strip orientated away from the inlet opening. The piece of material guides an air flow on the side of the material strip orientated away from the inlet opening (i.e. behind the strip) in the direction of the material strip. Hence, the material strip is easily raised by the air flow and at a spacing from the bag wall. It can be moved particularly well in the air flow, which results in an advantageous distribution of the dust in the bag interior. The piece of material can basically be connected at least partially to the material strip; however it can also not be connected to the material strip.

In particular, the deflecting strip can be configured to divide the air flow into at least two partial flows. Due to such a division into two or more partial flows, a more uniform distribution of the filter cake in the vacuum cleaner filter bag is achieved. In addition, the number of particles per partial flow, in comparison with the incoming air flow, is reduced, which reduces the loading of the bag walls by the individual partial flows.

The deflecting strip can be configured for dividing the air flow into at least two partial flows with different, in particular mutually opposite, flow directions. During operation of the vacuum cleaner filter bag, air enters through the inlet opening with a flow direction (inlet flow direction) and impinges on the deflecting strip. By means of the latter, the air flow is deflected so that a change in flow direction by the deflecting strip with respect to the flow direction at the inlet opening occurs. There is intended by the flow direction of the air flow or air flow direction, the main flow direction of the air which extends in general parallel to a wall, for example a vacuum cleaner pipe or connecting pipe. During operation of the vacuum cleaner, such a main flow direction is produced at every point through the vacuum cleaner pipe into the bag, even if possible turbulences can occur at some points.

Mutually opposite flow directions means that both flow directions have a component in the plane perpendicular to the flow direction with which an air flow impinges on the deflecting strip, i.e. therefore a component perpendicular to the inlet flow direction, both components enclosing an angle of approx. 180° and the components in this plane being respectively larger than the corresponding component parallel to the inlet flow direction. This means that (when regarding the flow direction vectorially) the two partial flow directions in the perpendicular projection are disposed anti-parallel in the plane perpendicular to the inlet flow direction.

The material strip can be disposed in particular in the interior of the vacuum cleaner filter bag on the side of the deflecting strip orientated away from the inlet opening. Viewed from the inlet opening, the material strip is then situated behind the deflecting strip and the piece of material behind the material strip. In particular, the material strip and/or the piece of material can be situated opposite the inlet opening.

The bag wall can comprise two wall parts made of filter material, the inlet opening being provided in a first wall part. The deflecting strip can be connected to the first wall part and/or to the second wall part. The material strip and/or the piece of material can be connected in particular to the second wall part. The material strip can also be connected to the first wall part. The second wall part can be situated opposite the inlet opening. In particular with a vacuum cleaner filter bag with a flat design, the two wall parts can be separate filter material pieces which are connected to each other. In the case of a vacuum cleaner filter bag with a pad or block base form, the two wall parts can be part of a continuous filter material piece, the two wall parts being defined by the lateral folds on the two sides of the pad base bag.

The vacuum cleaner filter bag can furthermore comprise a retaining plate for retaining the vacuum cleaner filter bag in a vacuum cleaner housing. The deflecting strip can be connected to the retaining plate.

The deflecting strip, the material strip and/or the piece of material can a have smaller surface area than that of the bag wall. Hence, deflection of the air flow and a movement of the two strips is advantageously made possible. For example, the deflecting strip, the material strip and/or the piece of material can have a smaller surface area than one of the wall parts.

The material strip and/or the piece of material can extend over the entire length of the bag wall, in particular of the second wall part. The width of the material strip and/or of the piece of material can however also be smaller than the width of the bag wall, in particular of the second wall part. The width can be in particular at most two thirds, preferably at most half of the width of the bag wall, in particular of the second wall part.

The material of the piece of material can have less air permeability than the material of the bag wall and/or of the material strip. Hence, an air flow is advantageously guided from behind (i.e. on the side orientated away from the inlet opening) in the direction of the material strip and hence makes it possible to raise the latter from the bag wall and to keep it at a spacing.

The material of the piece of material can have an air permeability of less than 2,000 $l/(m^2s)$, in particular less than 1,000 $l/(m^2s)$, in particular less than 500 $l/(m^2s)$.

In the case of the above-described vacuum cleaner filter bags, the piece of material can be disposed in the interior of the vacuum cleaner filter bag or outwith the vacuum cleaner filter bag or be configured as part of the bag wall. In particular, both in an arrangement in the interior and outwith, the piece of material can be connected to the bag wall. In an arrangement internally or externally, the piece of material is hence configured as an element separate or separated from the bag wall. The piece of material can be connected, additionally or alternatively, to the material strip.

According to one possibility, the piece of material can be disposed in the interior of the vacuum cleaner filter bag and be connected to the bag wall, the piece of material being disposed such that the material strip, with its side orientated away from the inlet opening, is retained at a spacing at least partially from the bag wall. Due to the spacing, guidance of the air flow below the material strip is made possible in a simple manner.

The piece of material can be configured such that the material strip is retained at a spacing at least partially by at least 0.1 mm, preferably at least 1.5 mm, further preferred at least 4 mm, from the bag wall, in particular from the second wall part. The piece of material can hence have in particular a thickness of at least 0.1 mm, preferably at least 1.5 mm, further preferred at least 4 mm. The spacing and hence also the thickness can reach up to several centimeters.

The material strip and/or the piece of material can in particular have a rectangular configuration. The material strip and/or the piece of material can be aligned parallel to the lateral edges of the bag wall, in particular of the second wall part. In particular, the two longitudinal sides of the material strip and/or of the piece of material can be disposed at a spacing from the corresponding (parallel) lateral edges of the bag wall or of the second wall part, for example in the centre with respect to the width of the second wall part.

The piece of material can be configured in the form of a strip. The material strip and the piece of material can be disposed one upon the other or one above the other; in this case, the piece of material is disposed in the interior of the vacuum cleaner filter bag. In particular in the case of a strip-shaped piece of material, the two strips lie in this way flat one on the other. Alternatively, the strip-shaped piece of material can also be attached on the bag wall externally. In this way, an air deflection can also be achieved from behind to the material strip since the air permeability is reduced in total in this region of the bag wall.

The piece of material and the material strip can have the same width and/or length. Alternatively, they can have a different width and/or length. In particular, the material strip can have a greater length and/or width than the piece of material.

The deflecting strip, the material strip and/or the piece of material can have a rectangular configuration; they can, in particular if they are configured as strips, be connected to the bag wall respectively along two oppositely situated edges, in particular along the short edges. In particular, the deflecting strip, the material strip and/or the piece of material can be connected to the bag wall only at these places, i.e. at two edges or borders. The material strip can however also be connected at these places to the deflecting strip.

Alternatively or additionally to the piece of material, the spacing means can comprise a connecting device via which the material strip is connected to the bag wall and/or to the deflecting strip. Hence, the invention also provides a vacuum cleaner filter bag, comprising a bag wall made of filter material, an inlet opening being provided in the bag wall, a deflecting strip for deflecting an air flow entering through the inlet opening, the deflecting strip being disposed in the interior of the vacuum cleaner filter bag, a material strip which is disposed in the interior of the vacuum cleaner filter bag and connected to the bag wall, at least a part of the edge of the material strip not being connected to the bag wall, and a connecting device via which the material strip is connected to the bag wall and/or to the deflecting strip in the mentioned manner.

It emerged that a high suction power is made possible over a long period of time also by a suitable connection of the material strip to the bag wall and/or to the deflecting strip. The piece of material in this case is not absolutely necessary. Because of the connecting device, an air flow can flow to the side of the material strip orientated away from the inlet opening. The material strip hence is moved in the air flow, which results in an advantageous distribution of the dust in the bag interior.

The spacing means can consist in particular of the piece of material and/or the connecting device. The connecting device can comprise at least one adhesive point and/or one weld point. Hence, the material strip can be connected advantageously to the bag wall and/or to the deflecting strip. The at least one adhesive point and the at least one weld point can be configured for example in the form of one or more adhesive or weld points or even linearly.

If for example the material strip has a rectangular configuration, it can, in particular if it is configured as a strip, be connected respectively along two oppositely situated edges, in particular along the short edges, to the bag wall and/or to the deflecting strip. The connection to the bag wall can be in particular on the seam or to the wall part in which the inlet opening is provided. In addition, the material strip can then be connected also to the deflecting strip and/or to the bag wall, in particular to the wall part in which the inlet opening is provided, for example it can be glued or welded.

In the case of the above-described vacuum cleaner filter bags, the bag wall can have a seam and the material strip and/or the piece of material on the seam can be connected to the bag wall, (in particular if the piece of material is configured as a separate element from the bag wall). In particular, a first wall part and a second wall part can be connected to each other via a seam and the material strip and/or the piece of material on the seam can be connected to the second wall part. This simplifies in particular production of the vacuum cleaner filter bag and makes it possible to configure the material strip and/or the piece of material over the entire length of the second wall part. The seam can be formed by a connecting seam, for example by a weld or adhesive seam.

As an alternative, the material strip and/or the piece of material can also be connected to the bag wall at a spacing from the seam.

The deflecting strip can have a smaller length than the length of the bag wall or of the first wall part. Alternatively, the deflecting strip can however also extend over the entire length of the bag wall or of the first wall part. The piece of material can have a smaller surface area than the material strip. In particular, the piece of material can have a smaller width and/or a smaller length than the material strip. Alternatively, the piece of material can however also protrude beyond the material strip in one or both dimensions, in particular be configured to be larger in one or both dimensions.

The deflecting strip, the material strip and/or the piece of material can have a width which is greater than the diameter of the inlet opening. The width of the deflecting strip can be smaller than the width of the material strip and/or of the piece of material.

In the above-described vacuum cleaner filter bags, the deflecting strip, the material strip and/or the piece of material can be slotted, in particular have a plurality of slots. In this way, respectively partial strips are formed which are possibly moveable relatively independently of each other. The slotting of the piece of material is advantageous in particular with separate pieces of material. In particular four to ten slots can be provided. The slots can have the same spacing. As a result of the slots, in particular partial strips can be formed, the width of which is 0.3 cm to 3.5 cm, in particular 0.5 cm to 1.5 cm. In particular, the slots can be at a spacing from each other by the mentioned dimensions.

The slots can be configured respectively parallel to a lateral edge of the deflecting strip, the material strip or the spacing element. In particular, the slots can be configured parallel to a respective longitudinal edge.

One or more slots can extend respectively essentially over the entire length of the deflecting strip, the material strip or piece of material and/or over the entire length between two connecting points. In particular, all the slots can extend over the entire length. Hence, the partial strips would extend over the entire length of the deflecting strip or the respective strip. The connecting points concern places at which the deflecting strip, the material strip and/or the piece of material are connected to the bag wall, i.e. for example the connecting seams at the short edges.

The connection of the deflecting strip, the material strip and/or the piece of material to the bag wall and/or to a retaining plate can be effected in particular by gluing or welding. The deflecting strip, the material strip and/or the piece of material can be glued or welded at points or in a line to the bag wall or the retaining plate. For example, the strips can have a rectangular configuration and be connected to the bag wall at their short edges at points or in a line. The piece of material can however also be glued or welded to the bag wall over the entire surface.

In the case of the above-described vacuum cleaner filter bags, the deflecting strip can comprise an air-permeable or an air-impermeable material or consist of this. The deflecting strip can comprise a nonwoven, in particular an extruded nonwoven, such as a fibre spun nonwoven (melt-spun microfibre nonwoven, "meltblown nonwoven") or a filament spun nonwoven ("spunbond fabric"), a fibre nonwoven, a wet-laid web and/or a dry-laid web, a paper, cardboard, a net, a woven fabric and/or a foil, for example perforated. The deflecting strip can comprise a laminate made of a plurality of the mentioned layers or consist thereof. The basis weight of the deflecting strip can extend from 10 g/m$^2$ to 300 g/m$^2$, in particular from 50 to 200 g/m$^2$.

The material strip and/or the piece of material can comprise a nonwoven, in particular an extruded nonwoven, such as a fibre spun nonwoven or a filament spun nonwoven, a wet-laid web and/or a dry-laid web, a paper, net, a woven fabric and/or a (perforated) foil. The deflecting strip and/or the piece of material can comprise a laminate made of a plurality of the mentioned layers or consist thereof. For example, the material strip and/or the piece of material can comprise a composite of two filament spun nonwoven layers, between which a dry-laid web made of staple fibres is disposed. The construction can be described for example as in DE 10 2005 059 214. The piece of material can comprise in particular also cardboard. The basis weight of the material strip and/or of the piece of material can extend from 20 g/m$^2$ to 300 g/m$^2$, in particular from 80 to 200 g/m$^2$. The air permeability of the material strip can extend from 100 to 10,000 l/(m$^2$s), in particular from 500 to 3,000 l/(m$^2$s).

The piece of material can also be formed by a treatment, in particular by compacting, of the bag wall. Hence, the piece of material is then not configured as a separate element. In particular, one region of the entire bag wall or one region of one or more layers of the bag wall can be compacted. Compacting can be achieved for example by full-surface thermal calendering. Hence, the air permeability in this region is reduced in comparison with the surrounding region.

The above-described vacuum cleaner filter bags can be disposable bags. They can be configured in particular as flat bags. In particular, these can consist of two rectangular wall parts which are connected to each other along their edges, for example welded or glued. Respectively one lateral fold can be introduced on two oppositely situated sides of the vacuum cleaner filter bag. On the first wall part, a retaining plate can be disposed at the inlet opening for retaining the vacuum cleaner filter bag in a vacuum cleaner housing.

BRIEF DESCRIPTION OF DRAWINGS

Further features and advantages of the invention are explained subsequently with reference to the Figures, given by way of example. There are thereby shown.

DETAILED DESCRIPTION

Figure 1:
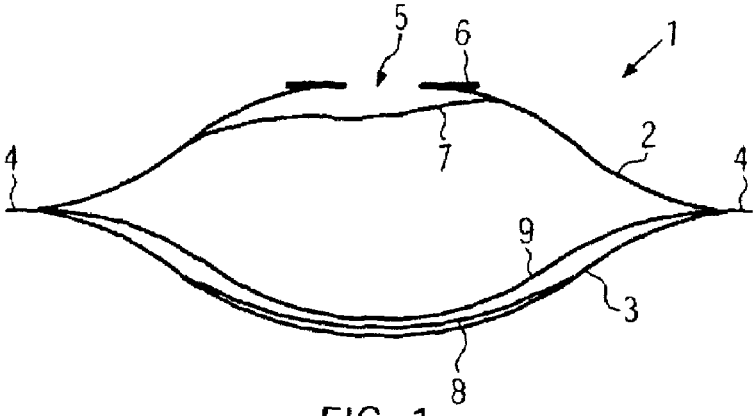
FIG. 1 a schematic cross-sectional view of an example of a vacuum cleaner filter bag.

In FIG. 1, a cross-sectional view of a vacuum cleaner filter bag 1 is shown schematically. The vacuum cleaner filter bag is constructed in the form of a flat bag. It consists of a first rectangular wall part 2 and a second rectangular wall part 3 which are constructed respectively from one or more layers of filter material. For example, each wall part can consist of a multilayer composite, comprising one or more nonwoven layers and/or one or more webs. Thus, between two extruded nonwoven layers, e.g. in the form of a fibre spun nonwoven or a filament spun nonwoven, a web layer made of staple fibres can be disposed, which is compacted by means of calendering between the nonwoven layers.

The term "nonwoven" is used according to the definition according to ISO standard ISO 9092: 1988 or CEN standard EN 29092. A nonwoven can be in particular dry- or wet-laid or be an extruded nonwoven, for example a fibre spun nonwoven (melt-spun microfibre nonwoven, "meltblown nonwoven"; the nomenclature is used according to W. Albrecht et al., "Vliesstoffe", Wiley-VCH, 2000, see for example p. 186) or filament spun nonwoven ("spunbond nonwoven"). The distinction between wet-laid nonwovens and conventional wet-laid paper is effected according to the above-mentioned definition as is also used by the International Association Serving The Nonwovens And Related Industries EDANA (www.edana.org). If paper or filter paper is mentioned, (conventional) wet-laid paper is hence meant, which is excluded in the above-mentioned definition of nonwoven. There is understood by a "web", a layer of still loose, i.e. unconnected, fibres. A nonwoven can then be obtained by compacting the loose fibres.

The following methods were used for the measurements of the various parameters. The basis weight was determined according to DIN EN ISO 9073-1. The thickness of the materials was determined according to DIN EN ISO 9073-2 (method A). The air permeability was determined according to EN ISO 9237 with a surface area of 20 $cm^2$ and a differential pressure of 200 Pa.

The two wall parts can have for example a construction, as described in the European patent application no. 07 013 312.9. Hence, a disposable bag can be produced advantageously.

In order to produce a flat bag, the two rectangular wall parts are laid one upon the other and connected to each other along their edge so that a seam 4 is produced by the circumferential connecting seam. This can thereby also concern for example an adhesive or weld seam.

The first wall part 2 has an inlet opening 5 through which an air flow enters into the vacuum cleaner filter bag during operation of the vacuum cleaner filter bag. Externally on the wall part, a retaining plate 6 is attached in the region of the inlet opening and serves to retain the vacuum filter bag in the interior of a vacuum cleaner. Such a retaining plate can be glued or welded for example to the filter material of the wall part.

In the interior of the vacuum cleaner filter bag, a deflecting strip 7 is disposed on the first wall part 2. The strip has a rectangular configuration in the illustrated example and is connected along the two short edges (perpendicular to the drawing plane) to the filter material of the first wall part, for example is glued or welded. With the exception of the two connecting seams along the short edges, the deflecting strip 7 is connected loosely, i.e. not to the bag wall. No connecting seam is provided in particular along the long edges. Alternatively, the deflecting strip can also be connected (at least along one edge) to the retaining plate and/or to the second wall part.

In the illustrated example, the deflecting strip 7 is disposed in the region of the inlet opening 5, i.e. does not extend over the entire length of the first wall part 2. It can have a length of 20 cm and a width of 7 cm. The arrangement of the deflecting strip with respect to the inlet opening can be asymmetrical (as in the illustrated example) or symmetrical. The dimensions of the deflecting strip 7 can be chosen such that the inlet opening 5 is covered.

Basically, the deflecting strip 7 can consist of an air-impermeable or air-permeable material. It can have a single- or multilayer construction. For example, the deflecting strip 7 can consist of a filament spun nonwoven layer connected to a (air-impermeable) foil. The deflecting strip can thereby have a basis weight of 150 $g/m^2$.

In the interior of the vacuum cleaner filter bag, a material strip 9 and a spacing means are disposed in addition. The spacing means is configured as a strip-shaped piece of material 8. The material strip 9 and the piece of material 8 are both connected to the second wall part 3. In this way, the material strip 9 and the piece of material 8 are disposed on the side of the vacuum cleaner filter bag situated opposite the inlet opening 5. As can be seen in particular also from the examples described further on, neither the material strip nor the piece of material require to be connected on one or both sides to the second wall part; thus, for example a connection to each other and/or to the first wall part is likewise possible.

The piece of material can for example also be folded or pleated. The piece of material need not have a strip-shaped configuration. It can also concern for example a piece of cardboard which has a folded structure such that the spacing of the material strip by a desired amount is achieved. Furthermore, the piece of material can also be attached in the same way externally on the bag wall. According to a further alternative, the piece of material can also be obtained by compaction of a region of the bag wall.

In the illustrated example, the material strip extends over the entire length of the second wall part 3; the piece of material has a shorter configuration. For example, the material strip can have a length of 26 cm, which corresponds to the length of the wall part, and a width of 11 cm. The piece of material can have a length of 22 cm and a width of 8 cm. Furthermore, the piece of material 8 is disposed under the material strip 9, i.e. between the material strip and bag wall.

It has emerged that for example pieces of material with other dimensions likewise show very good results. For example, also a foil with a size of 80×40 mm, which is disposed thereunder transversely relative to the material strip and connected to the bag wall at the four corners respectively via a weld point, can be used.

In the illustrated example, the connection of the material strip to the second wall part is achieved in that the material strip extends into the seam 4 and is connected to the second wall part and also to the first wall part via the connection of the seam (for example a weld or adhesive seam). The strip-shaped piece of material is glued or welded to the second wall part. In particular the piece of material can be glued or welded also over the full surface to the bag wall both at points or linearly. As an alternative to the illustrated variant, the material strip can also be connected to the bag wall on one or both sides not via the seam but directly to the first wall part 2 at places at a spacing from the seam, for example glued or welded. In this case, the material strip advantageously does not extend over the entire length of the first or second wall part.

The two strips can, but need not, have the same configuration. They can differ in particular in the dimensionings, materials, air permeabilities and/or basis weights. Preferably, both strips have a width however which is greater than the diameter of the inlet opening 5.

Thus, the material strip and the piece of material can have for example two cover nonwovens in the form of a filament spun nonwoven between which a web made of loose fibres (in particular crimped fibres) is disposed, which is connected to the filament spun nonwoven layers by means of calendering. The basis weight of the material strip and of the piece of material in the example can be between 100 and 200 g/m$^2$; the thickness of both strips can respectively be 3-4 mm. The air permeability of the piece of material is preferably below 2,000 l/(m$^2$ s). Alternatively, the piece of material can also be configured in the shape of a foil which can be for example air-impermeable or perforated. Such a foil can have a thickness of for example 0.1 mm.

During operation, an air flow enters through the inlet opening 5 into the vacuum cleaner filter bag and is deflected by the deflecting strip 7. According to the configuration and arrangement of the deflecting strip, the incoming air flow is divided in particular into two partial flows with different flow directions.

Because of the deflection, the air can flow in particular below and between the two strips and set these in motion so that the suctioned-in dust can be distributed uniformly in the interior of the vacuum cleaner filter bag.

The piece of material can be disposed symmetrically (i.e. with the same spacing in width and/or in length from the bag edge) with respect to the inlet opening and/or the bag wall, in particular the second wall part. Alternatively, the arrangement can also be asymmetrical with respect to the inlet opening and/or the bag wall, in particular the second wall part.

Figure 2:
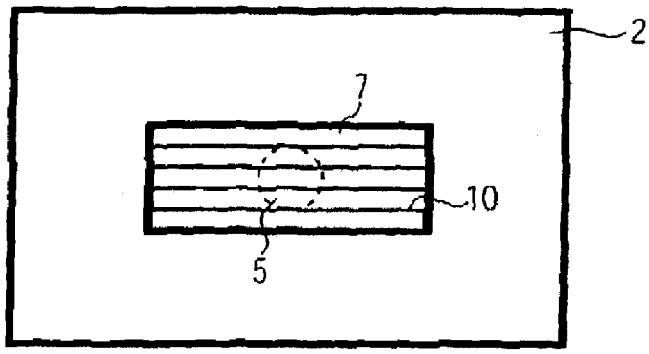
FIG. 2 a schematic plan view on an example of a first wall part.

In FIG. 2, a plan view (from the interior of the vacuum cleaner filter bag) onto an example of a first wall part 2 is shown schematically. The inlet opening 5 is drawn in broken lines. Covering the inlet opening 5 is a deflecting strip 7 connected to the first wall part 2. This connection can be effected in particular via weld or adhesive seams along the short edges of the deflecting strip. Otherwise, the deflecting strip is unconnected, i.e. loose.

The deflecting strip 7 has a rectangular design and is disposed parallel to the edges of the first wall part, but at a spacing from the latter.

Basically, the deflecting strip can be a continuous strip. Alternatively, as in the illustrated example, slots 10 can however be provided in the deflecting strip. In this way, the deflecting strip is then composed of a plurality of partial strips, of five partial strips in the illustrated example.

In the illustrated example, the slots extend over the entire length of the deflecting strip or over the entire length between the two connecting seams at the short edges. Alternatively, also a part of the slots or all of the slots can however have a shorter configuration than the length of the deflecting strip. In the illustrated example, the slots are disposed parallel to the longitudinal side of the deflecting strip. Also other orientations of the slots are possible here as an alternative. The slots make it possible for the different regions of the deflecting strip to be moveable relatively independently of each other. Furthermore, air can flow relatively unimpeded through the slots so that the impact upon the two partial flows is slightly reduced.

Figure 3:
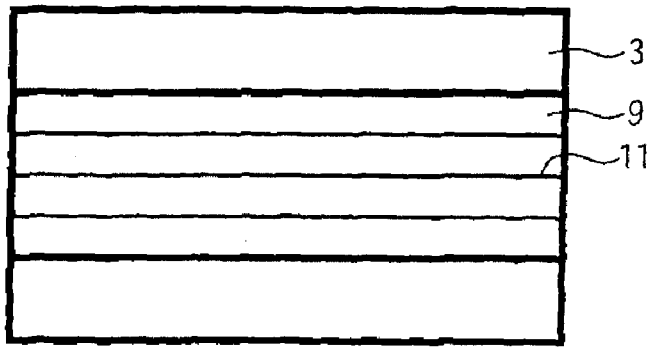
FIG. 3 a schematic plan view on an example of a second wall part.

In FIG. 3, a plan view on the inside of a second wall part 3 is shown schematically. This side is situated in the manufactured vacuum cleaner filter bag opposite the side shown in FIG. 2 and hence opposite the inlet opening. A material strip 9 is connected to the second wall part 3 and is disposed above a strip-shaped piece of material, the latter not being able to be seen in this plan view. The material strip 9 extends over the entire length of the second wall part 3, however it has a smaller width; it can have the dimensions in particular mentioned in conjunction with FIG. 1. Alternatively, the material strip can however also have a shorter length than the length of the second wall part.

The material strip 9 is connected to the second wall part via the circumferential seam of the vacuum cleaner filter bag. Basically, the material strip 9 can consist of a continuous piece of material. Alternatively, the strip 9, as in the illustrated example, can however have slots 11 by means of which partial strips, four partial strips in the illustrated example, are formed. In the illustrated example, the slots extend over the entire length of the strip. Alternatively, the slots can however also be shorter or have another orientation. The partial strips can have for example a width of 12.5 mm.

The strip-shaped piece of material in the example has a smaller length and width than the material strip and is hence covered by the latter. The strip-shaped piece of material can likewise be slotted.

Furthermore, it is possible, but not required, that the material strip and the strip-shaped piece of material respectively have slots of the same type (orientation, length, width etc.). For example, also one of the two strips can have slots over the entire length and the other strip can have merely shorter slots or none at all. Furthermore, the slots in the material strip and in the strip-shaped piece of material can be disposed aligned or mutually offset. In the former case, this means that the projection of the slots of the material strip on the piece of material are situated on the slots of the piece of material. In the latter case, the projection of the slots relative to the slots of the piece of material itself would be offset.

Basically, the deflecting strip can, but need not, cover the inlet opening completely. The (geometric) centre of the deflecting strip can be displaced with respect to the centre (or a straight line standing perpendicular to the plane of the inlet opening and extending through the centre thereof) of the inlet opening can be displaced. Furthermore, also the material strip and/or the piece of material can be displaced mutually and/or relative to the inlet opening. In particular, the centres of the deflecting strip, of the material strip and/or of the piece of material can be displaced mutually and/or relative to the centre of the inlet opening.

Figure 4:
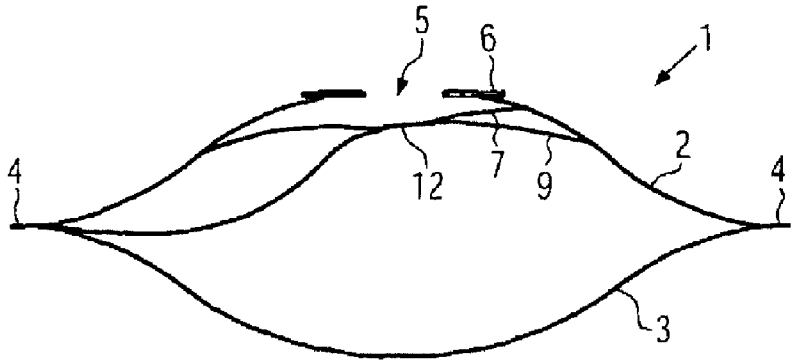
FIG. 4 a schematic cross-sectional view of a further example of a vacuum cleaner filter bag.

In the embodiment shown in FIG. 4, the spacing means consists of a connecting point 12 between the material strip 9 and the deflecting strip 7. This connecting point 12 can concern a punctiform or linear adhesive or weld point. In this example, the deflecting strip is configured as in the case of FIG. 1, even if other dimensions and arrangements are possible on the first wall part 2.

The material strip 9 is connected to the first and the second wall part at the left edge via the seam 4. At its right edge, the material strip is connected to the first wall part (e.g. glued or welded), this connection being situated at a position at a spacing from the seam. In addition, a connection to the deflecting strip 7 is effected in order to keep the material strip at a spacing, during operation of the vacuum cleaner filter bag, from the bag wall, in particular from the second wall part 3. In this case, an additional piece of material, such as the piece of material 8 in FIG. 1, is not required. However, such a piece of material can nevertheless be provided, in particular in order further to assist and increase lifting of the material strip.

Various modifications to the example shown in FIG. 4 are possible, Thus, for example two connecting points of the material strip 9 to the deflecting strip 7, which are at a spacing from each other, can be provided. In particular, the material strip can be connected to the deflecting strip at the points at which the deflecting strip is connected to the bag wall. For this purpose, a continuous weld joint of bag wall, deflecting strip and material strip could be configured. If the material strip is connected in particular at two points to the deflecting strip, the material strip need no longer extend beyond the deflecting strip. Hence, a type of doubling of the deflecting strip is then provided. Further connections of the material strip to the bag wall are not required. In particular in this case, slots in the deflecting strip and material strip, in particular in a mutually offset form, are advantageous.

As a further alternative to the variant shown in FIG. 4, the connection on the right side of the material strip can also be effected via the seam on the right side of the bag.

Figure 5:
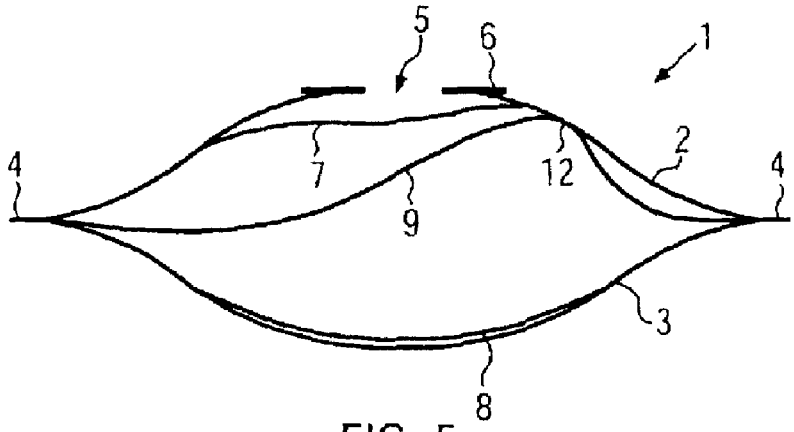
FIG. 5 a schematic cross-sectional view of a further example of a vacuum cleaner filter bag.

In FIG. 5, the spacing means consists both of the piece of material 8 and of the connecting point 12, the piece of material also being optional in this example. The piece of material can be configured in particular as described in conjunction with FIG. 1. The material strip 9 is connected, on the one hand, on both sides via the seam 4 to the bag wall. On the other hand, an adhesive or weld point 12 is provided so that the material strip 9 is connected in addition also to the first wall part 2.

Figure 6:
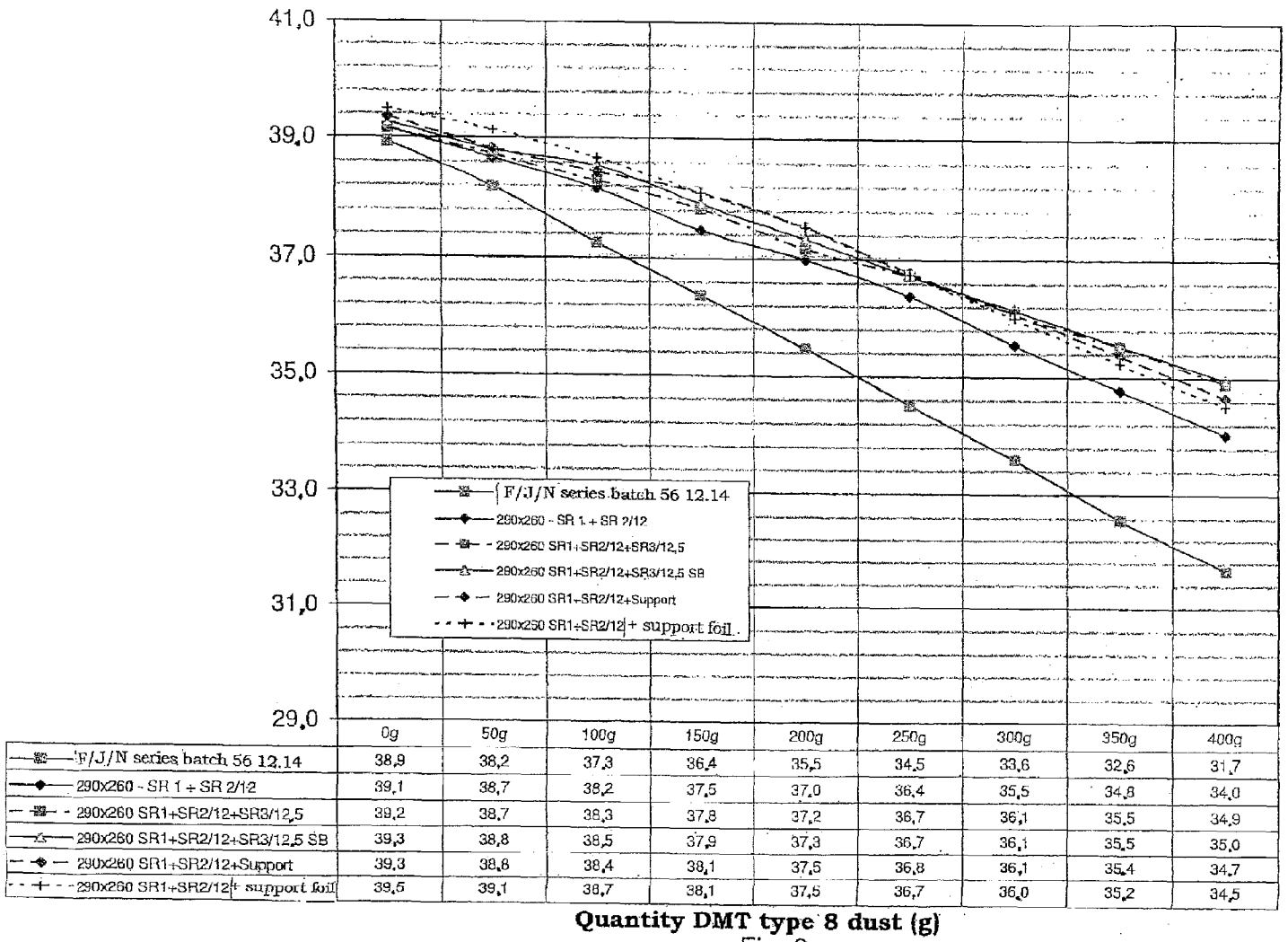
FIG. 6 comparative measurements for different vacuum cleaner filter bags.

In FIG. 6, comparative measurements for different vacuum filter bag configurations are shown. A dust loading test with DMT dust (type 8) was implemented according to EN 60312 (Draft $4^{th}$ edition). The vacuum cleaner used concerns a Miele S 712 SAC. The standard motor protection filter and the standard blow out filter were used. The vacuum cleaner filter bags F/J/N Series (Batch 56 12.14), obtainable from the company Wolf GmbH & Co. KG, constitute the basis of the tests. The dimensions of this flat bag are 290×260 mm.

In the case of the measurement described in FIG. 6 by "F/J/N Series Batch 56 12.14", this vacuum cleaner filter bag was tested without further modification. "290×260–SR 1+SR 2/12" describes the same bag, however in modified form. A deflecting strip ("SR 1") with the dimensions 200×70 mm was inserted in this bag. This deflecting strip extends from the seam of the filter bag over the inlet opening and is welded to the bag wall at its short edges (on the one side on the bag seam). The deflecting strip consists of a filament spun nonwoven layer (150 g/$m^2$) which is connected to a foil over the entire surface.

Furthermore, a material strip ("SR 2") is provided in this variant, which has a size of 260×110 mm and hence is attached to the seam at both short edges. This material strip has 9 continuous slots with a width of respectively approx. 12 mm. It concerns two filament spun nonwoven layers between which a layer of crimped fibres is disposed. The entire thickness of the material strip is approx. 4 mm. For a bag modified in this way, a substantially improved volume flow, with a dust loading of 400 g, is produced.

Next ("290×260–SR 1+SR 2/12+SR3/12.5"), the same vacuum cleaner bag was used again, likewise with the already mentioned deflecting strips and material strips. In addition, a piece of material ("SR3") is provided. The piece of material has the dimensions 220×80 mm and is made of the same material as the material strip. The piece of material is disposed symmetrically with respect to the inlet opening and the second wall part. The piece of material has 6 continuous strips with a width of approx. 12.5 mm.

"290×260–SR 1+SR 2/12+SR3/12.5 SB" describes in turn the same vacuum cleaner bag with the already mentioned deflecting strips and material strips. The piece of material here is provided in the form of a filament spun nonwoven which is approx. 0.2 mm thick.

In the case of "290×260–SR 1+SR 2/12+Support", the piece of material is configured in the form of an (unslotted) strip with a width of 2 cm and the same length as the material strip. The piece of material in turn has the same material as the material strip (see above).

"290×260–SR 1+SR 2/12+Support foil" describes a bag as in the above example, the piece of material here being configured in the shape of a 40×80 mm large PP foil which is disposed transversely relative to the material strip in the centre of the second wall part; the longitudinal dimension of the material strip is therefore perpendicular to the longitudinal dimension of the piece of material.

It can be seen from these examples that a piece of material with which the air is directed from the rear to the material strip, significantly improves the volume flow, even with a dust loading of 400 g, in comparison with a conventional vacuum cleaner bag. The same applies correspondingly if, instead of the piece of material, a connecting device, for example an additional adhesive or weld point, is used in order to keep the material strip at a spacing from the bag wall during operation.

The invention claimed is:

1. A vacuum cleaner filter bag, comprising:

a bag wall made of a filter material, the bag wall having an inlet opening;

a deflecting strip deflecting an air flow entering through the inlet opening, the deflecting strip being disposed in an interior of the bag;

a material strip disposed in the bag interior and connected to the bag wall, at least a part of an edge of the material strip not being connected to the bag wall; and a spacing arrangement configured such that the material strip is at a spacing at least partially from the bag wall during operation of the bag, wherein the spacing arrangement includes a piece of material which is provided on a side of the material strip orientated away from the inlet opening, and wherein the piece of material is disposed in the bag interior and connected to the bag wall, the piece of material being disposed such that the material strip is retained at a spacing at least partially from the bag wall by its side orientated away from the inlet opening.

2. The bag according to claim 1, wherein the material of the piece has less air permeability than at least one of (a) the material of the bag wall and (b) the material strip.

3. The bag according to claim 1, wherein the piece of material is one of (a) disposed one of (1) in the bag interior and (2) outwith the bag and (b) configured as part of the bag wall.

4. The bag according to claim 1, wherein the piece of material is connected to at least one of the bag wall and the material strip.

5. The bag according to claim 1, wherein the piece of material is configured in the form of a strip.

6. The bag according to claim 1, wherein at least one of the material strip and the piece of material extending over an entire length of the bag wall.

7. The bag according to claim 1, wherein the spacing arrangement includes a connecting device via which the material strip is connected to at least one of the bag wall and the deflecting strip.

8. The bag according to claim 7, wherein the connecting device includes at least one of (a) at least one adhesive point and (b) at least one weld point.

9. The bag according to claim 1, wherein the bag wall has a seam, at least one of the material strip and the piece of material being connected at the seam to the bag wall.

10. The bag according to claim 1, wherein the deflecting strip has at least one of (a) a smaller length than a length of the bag wall and (b) a smaller width than a width of the bag wall.

11. The bag according to claim 1, wherein at least one of the deflecting strip, the material strip and the piece of material has a width which is greater than a diameter of the inlet opening.

12. The bag according to claim 1, wherein a width of the deflecting strip is smaller than at least one of (a) a width of the material strip and (b) a width of the piece of material.

13. The bag according to claim 1, wherein at least one of the deflecting strip, the material strip and the piece of material is slotted.

14. The bag according to claim 1, wherein at least one of the deflecting strip, the material strip and the piece of material is slotted and includes a plurality of slots.

15. The bag according to claim 1, wherein the piece of material is formed by a treatment of the bag wall.

16. The bag according to claim 1, wherein the piece of material is formed by a compaction of the bag wall.

* * * * *